United States Patent [19]

Golding

[11] 4,333,504

[45] Jun. 8, 1982

[54] CONTAINER FILLING MACHINE

[75] Inventor: Cyril G. Golding, Sedgley, England

[73] Assignee: GKN Sankey Limited, Telford, England

[21] Appl. No.: 147,495

[22] Filed: May 7, 1980

[30] Foreign Application Priority Data

May 12, 1979 [GB] United Kingdom ..... 7916585

[51] Int. Cl.[3] ..... B65B 31/00

[52] U.S. Cl. ..... 141/55; 141/90; 141/94; 141/302

[58] Field of Search ..... 141/4, 5, 39, 90, 47, 141/48, 55, 95, 284, 94, 291, 302, 348, 349, DIG. 1

[56] References Cited

U.S. PATENT DOCUMENTS 623,758 4/1899 Swietusch ..... 141/55 X 1,155,009 9/1915 Schlangen ..... 141/55

*Primary Examiner*—Frederick R. Schmidt

*Attorney, Agent, or Firm*—Merriam, Marshall & Bicknell

[57] ABSTRACT

A machine for filling beer kegs via a movable head which carries a change-over valve in series with a beer inlet valve, the change-over valve being arranged so that during the beer save operation at the end of each filling cycle the beer between the inlet valve and the change-over valve is isolated so that it remains sterile and can be used in the next filling cycle.

4 Claims, 3 Drawing Figures

CONTAINER FILLING MACHINE

BACKGROUND OF THE INVENTION

The invention relates to machines for filling containers with liquid.

Specifically, the invention has been developed for the filling of beer kegs. Such a keg has a closure unit which has one or two spring loaded valve members which act to seal the keg. The closure units are arranged so that the valve members may be opened to fill the keg, or dispense beer from the keg, with the closure unit in place in the keg. Such a keg is filled against a counter-pressure of carbon dioxide and beer is dispensed from a keg under a top pressure of carbon dioxide.

When a keg has been filled with beer, before it is disengaged from the head through which it has been filled, the pipework is cleared of beer. This is known as "saving" the beer and is the last step carried out before the filled keg is disengaged from the filling head.

Although the beer is saved, before it can be used again, it has to be resterilized and this of course is expensive.

SUMMARY OF THE INVENTION

The object of the present invention is to provide a machine in which the quantity of beer which has to be saved is less than in presently operated machines.

According to the invention we provide a machine for filling with liquid containers having spring-loaded closure units, the filling being carried out via a head which seals with a container to be filled and which carries means to open the closure unit of the container, the machine comprising a main frame, a filling head movable relative to the frame to engage the container to be filled, liquid inlet and outlet valves fixed on the frame, a gas inlet valve fixed on the frame, a change-over valve fixed to the head and operable in synchronism with said inlet valve, separate conduits between the change-over valve on the one hand and the liquid inlet and outlet valves on the other, the change-over valve having a first state in which the head communicates with the liquid inlet valve and a second state in which the head communicates with the liquid outlet valve, a conduit between the gas inlet valve and the head and control means arranged so that during filling of a container its closure unit is open, the liquid inlet valve is open and the change-over valve is in its first state so that liquid passes through the liquid inlet valve, the change-over valve and the head into the container and upon termination of filling the closure unit and the liquid inlet valve are closed and the change-over valve is changed over to its second state and the gas inlet valve is opened to enable gas to clear the head of liquid which is driven by the gas through the liquid outlet valve.

By having a change-over valve on the head, the liquid in the conduit between the liquid inlet valve and the change-over valve does not need to be saved and is isolated between the liquid inlet valve and the change-over valve. This liquid can therefore be used in the next filling cycle and does not have to go and be reprocessed before it can again be used.

Preferably, the machine includes a second outlet valve in series with a pressure relief valve, said second valve being open during filling, the liquid entering the container displacing gas in the container and the pressure of the gas being maintained by the pressure relief valve.

Preferably, also, the machine includes means to pass steam across the head before filling commences and while the closure unit of the container in still closed.

BRIEF DESCRIPTION OF THE DRAWINGS

The invention will now be described in detail by way of example with reference to the accompanying drawings in which.

DESCRIPTION OF PREFERRED EMBODIMENTS

Figure 1:
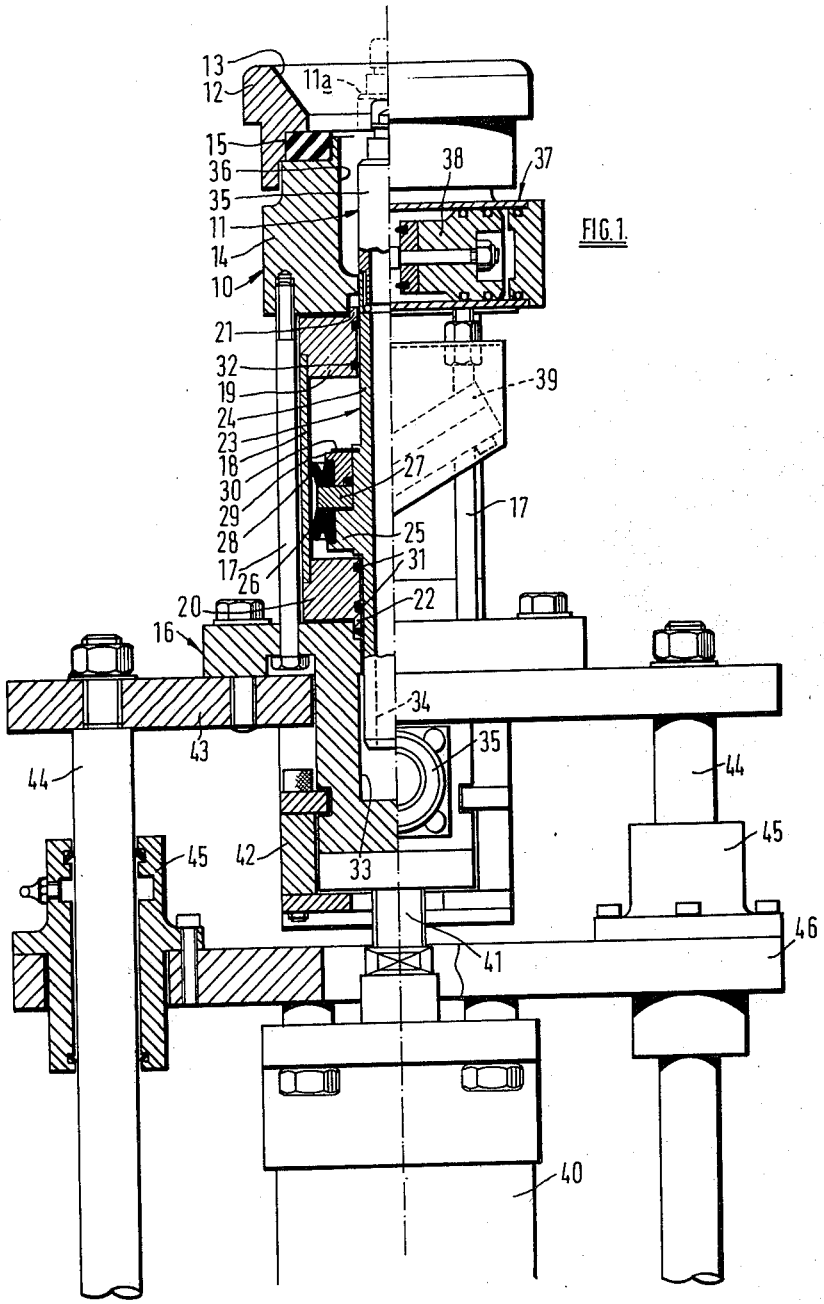
FIG. 1 is a part section and part elevation of a head arrangement in the machine embodying the invention.

Referring now to FIG. 1, the head is indicated generally at 10 and the probe at 11. The head comprises a cup 12 having a convergent bore 13 to receive the neck of a container, not shown. The cup 12 is threadedly engaged with the upper end of an upper block 14 and a sealing washer for engaging the container neck is indicated at 15. The upper block 14 is secured to a mounting plate 16 by a plurality of bolts, two of which are shown at 17. Between the block 14 and the mounting plate 16 is arranged a cylinder comprising a cylindrical brass sleeve 18 and end pieces 19 and 20 which fit within the sleeve 19 and have spigots 21 and 22 respectively to fit within locating bores in the block 14 and plate 16 respectively.

The probe 11 comprises a tubular piston 23 having a central tubular part 24 and an integral flange 25. Seated on the flange 25 is a first sealing washer 26 and above this is a magnetic collar 27. Above the collar is a further sealing washer 28 and above that a ring 29 held in position by a circlip 30. The washers 26 and 28 engage the bore of the sleeve 18. Means, not shown, is provided for introducing compressed air above or below the washer assembly 26, 28 so as to move the probe vertically up or down.

The lower portion of the tubular part 24 of the probe passes through ring seals 31 in the end piece 20 and the upper portion is sealed with ring seals 32 to the end piece 19. A chamber 33 is formed in the mounting plate 16 into which the lower part of the tubular piston 23 projects and the bore 34 of the piston communicates with the chamber and the chamber is provided with a spigot 35 so that a service can be connected to the chamber 33 and thus to the bore 34 of the tubular part 23.

The upper part of the tubular piston 23 has secured thereto a cap 35 which is so shaped as to be capable of opening and sealing with the closure member of a container. The cap is located in a chamber 36 formed in the upper block 14 and this chamber 36 is also connected to services via two outlets, shown in FIGS. 2 and 3, via a change-over valve 37. The change-over valve includes a pneumatically operated piston 38 which is arranged so that when it is in the position shown the chamber 36 is in connection with one of the outlets of the change-over valve, the piston being movable to another position in which the chamber 36 is in communication with the other outlet of the change-over valve.

Mounted externally of the cylinder 18 is a magnetically-sensitive reed switch 39 which is sensitive to the position of the magnetic collar 27.

The whole of the head assembly is reciprocable vertically by a pneumatic ram 40 which has its piston rod 41 connected via a U-piece 42 to a bridge piece 43. The bridge piece 43 has secured thereto the mounting plate 16 and is guided for vertical movement by two guide rods 44 which slide in bushes 45 secured to the main frame of the machine, part of which is shown at 46.

In operation, the whole of the head is moved upwardly by the ram 40 to engage and seal with the neck of a container. Once the head has been sealed to the container neck the probe 11 is moved within the head from the lower position shown in full lines to the position shown in chain lines at 11*a*. This movement is effected by applying fluid pressure beneath the washer assembly 26, 28 thus causing the tubular piston 23 to move up within the cylinder 18. As the probe moves upwardly, it opens the valve members of the closure unit in the container so that the container may now be washed or filled via the chamber 36 and the change-over valve 37 and up through the bore 34 from the chamber 33 which is supplied by the spigot 35.

When the probe reaches its fully extended position in which it will have opened and sealed with the closure unit and the container, the reed switch 39 is operated by the magnetic collar 27. The reed switch is inserted into the control circuit of the machine and is arranged so that the washing or filling sequence of the head is only carried out if the probe is in its fully extended position as evidenced by the operation of the reed switch 39 by the magnetic collar 27.

Figure 2:
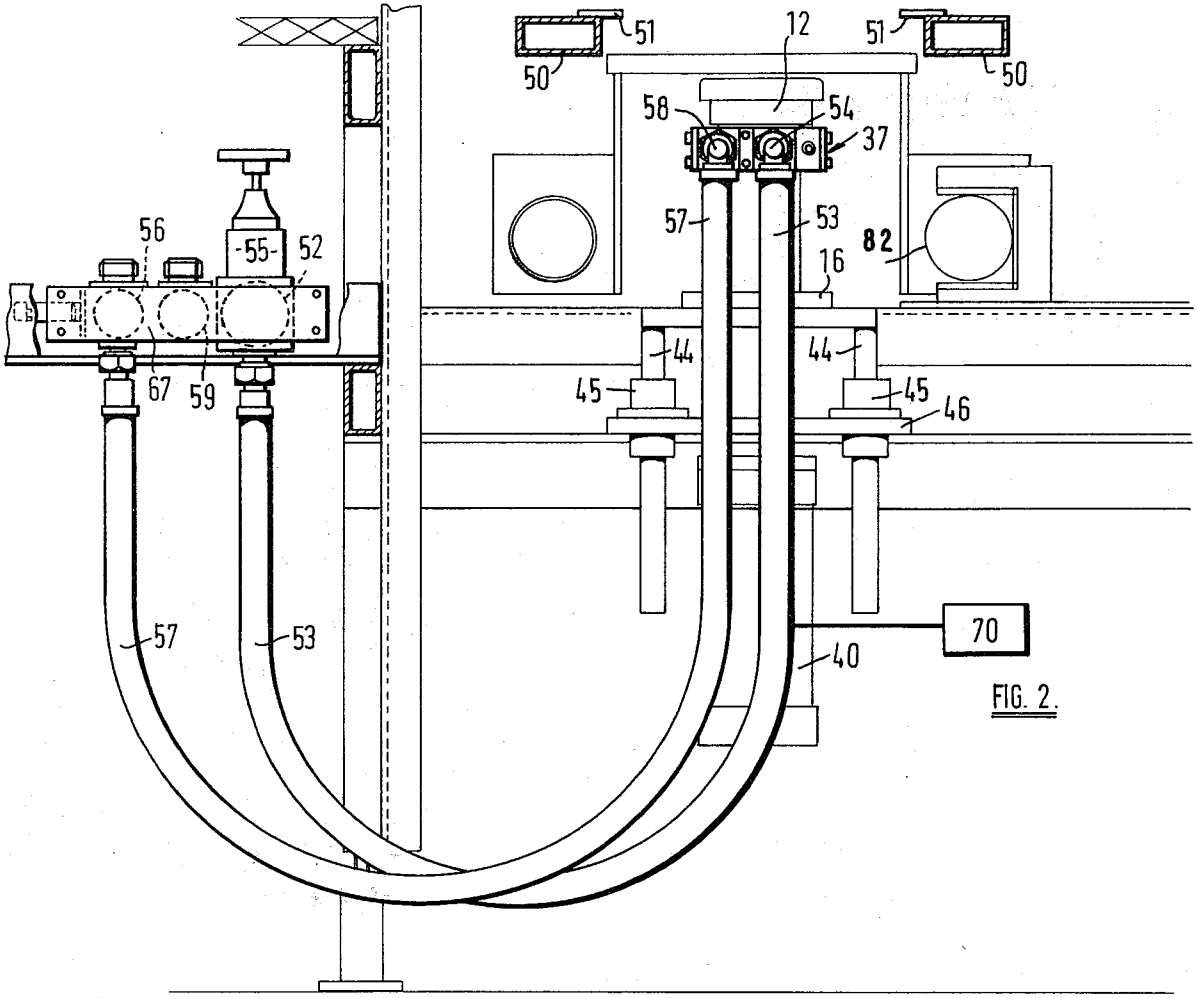
FIGS. 2 and 3 illustrate the connections between valves on the main frame of the machine and the head shown in FIG. 1.
Figure 3:
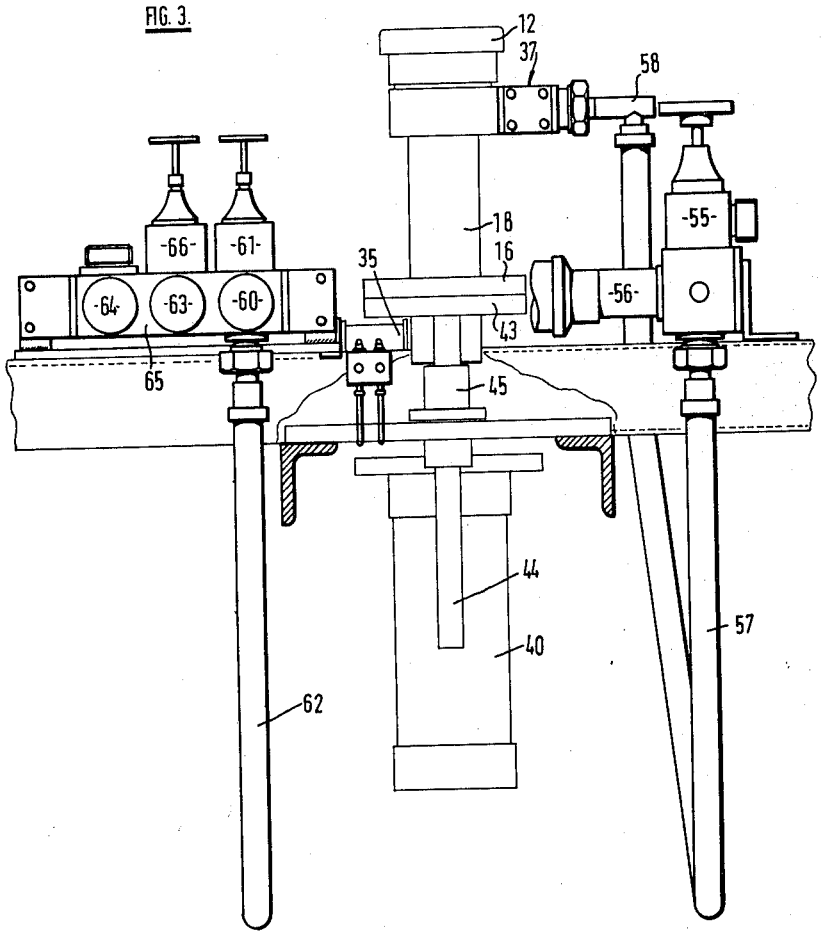

Referring now to FIGS. 2 and 3 these show the head arrangement in the main frame of the machine which includes two rails 50 having flanges 51 on which a container rests. Means indicated generally at 82 is provided for moving the containers between stations at each of which is a head such as 12.

Referring to FIG. 2, the liquid inlet valve is shown at 52 and is connected by a flexible conduit 53 to one outlet 54 of the change-over valve 37. The valve 52 is pneumatically operated and is in series with a manually operated valve 55. A liquid outlet valve is indicated at 56 and this is connected by a flexible conduit 57 to the other outlet 58 of the change-over valve 37. A steam outlet valve 59 is also connected to the outlet 58 via the conduit 57.

A pressure sensor 70 is connected into the conduit 53 for monitoring any variation in pressure in the conduit from a pre-determined pressure value as will be further described herein with reference to the container filling operation.

Referring to FIG. 3, there is a gas inlet valve 60 which is in series with a manually operated valve 61, the gas inlet valve is connected by a flexible conduit 62 to the spigot 35 of the head. A steam inlet valve 63 and a second outlet valve 64 are also connected to the spigot 35 via the conduit 62 and a manifold block 65. The steam inlet valve 63 is in series with a manually operated valve 66. The valve 64 is in series with a pressure-relief valve not shown.

The cycle of operation of the filling head is as described below for the filling of a container with beer, all the valves 52, 56, 59, 60, 63 and 64 being closed unless stated as being open. The cycle is as follows:

1. The valve 60 is opened and carbon dioxide under pressure is applied to the head to test for leakage between the head and the container neck with which it is engaged.

2. The valves 59 and 63 are opened so that steam passes along the conduit 62 and up through the probe 11, across the head, and out through the valve 58 and conduit 57 through manifold 67 to the valve 59. This steam sterilizes the head only, as at this time the container closure unit is not open.

3. The probe 11 is now moved to its fully extended position at 11*a* to open the valve means in the container closure unit. Its position is ascertained by the operation of the reed switch 39.

4. Filling now commences with the valves 52, 54 and 64 being open. Beer flows through the valve 52 along the conduit 53 and into the change-over valve 37 which is in its first state connecting the chamber 36 in the block 14 with the conduit 53 and cutting off the outlet 58 from the chamber. Beer flows into the container and carbon dioxide is displaced down through the probe and escapes through the spigot 35 and passes along the conduit 62 and through the manifold 65 and out through the valve 64, the pressure in the container being maintained by the pressure relief valve associated with the valve 64.

5. The valve 52 is closed when filling is complete and upon closure of the valve 52 the change-over valve 37 changes over to isolate the conduit 53 from the chamber 36 and to connect the chamber to the outlet 58 and thus to the conduit 57. However, valve 64 is not closed until a predetermined period of time has elapsed after closure of valve 52 whereby any excess pressure in the keg may be dissipated through the pressure relief valve associated with valve 64.

6. The valves 60 and 56 are now opened and carbon dioxide is supplied to the spigot 35 and saves any beer in the head which is driven along the conduit 57 out through the beer outlet valve 56. The beer in the conduit 53 is isolated between the change-over valve 37 and the beer inlet valve 52 and is thus retained sterile and may be used to be filled into the next container on the next filling cycle.

7. The valves 56 and 60 are then closed and the head disengaged from the container which is now full.

It will be appreciated that, apart from sequence 4 above, the valve 52 is closed at all times and outlet 54 in the changeover valve 37 is also closed. Thus a closed volume of conduit 53 exists between valve 52 and changeover valve outlet 54 except when beer is actually being filled into the container at which time of course valve 52 and outlet 54 are open, and it is this closed volume of conduit 53 whose pressure is monitored by sensor 70. Thus any pressure variation from the predetermined value will indicate a malfunction in either or both of valve 52 and changeover valve 37 and the sensor may operate associated switch means to suspend the cycle of operation.

It will be seen that by having the change-over valve 37 on the head the beer in the conduit 53 at the end of filling can be isolated and reused and it is not necessary for this beer to be saved. There is thus a considerable saving in the transport and reprocessing of the saved beer.

I claim:

1. A machine for filling with liquid containers having spring-loaded closure units, the filling being carried out via a head which seals with a container to be filled and which carries means to open the closure unit of said container, the machine comprising:

a main frame and a filling head movable relative to the frame to engage a container to be filled, a liquid inlet valve on the frame and a conduit from the liquid inlet valve to a change-over valve fixed to the head, a liquid outlet valve on the frame and a conduit from the liquid outlet valve to the change-over valve, a gas inlet valve fixed on the frame and a conduit from the gas inlet valve to the head, said change-over valve being operable in synchronism with the liquid inlet valve, the change-over valve being adjustable to a first state in which the head communicates with the liquid inlet valve and a second state in which the head communicates wih the liquid outlet valve, and, control means arranged so that during filling of a container the container closure unit is open, the liquid inlet valve is open and the change-over valve is in its first state so that liquid passes through the liquid inlet valve and the conduit from it to the change-over valve, then to the head and then into the container and, upon termination of filling, the container closure unit and the liquid inlet valve are closed, the change-over valve is changed over to its second state and the gas inlet valve is opened so that gas can flow from the gas inlet valve through the conduit from it to the head to enable the gas to clear the head of liquid which is driven by the gas through the change-over valve into the conduit therefrom to the liquid outlet valve.

2. A machine according to claim 1 including a second gas or outlet valve in series with a pressure relief valve, said second outlet valve communicating with the conduit from the gas inlet valve to the head and being opened during filling and maintaining a pressure of gas on the liquid being filled.

3. A machine according to claim 1 including a pressure sensor connected into the conduit between the liquid inlet valve and the changeover valve monitoring any variation in pressure within said conduit occuring with the changeover valve is in its said first state.

4. A machine according to claim 1 including means to pass steam across the head before filling commences.

* * * * *